US005328046A

United States Patent [19]

Kutz et al.

[11] Patent Number: 5,328,046

[45] Date of Patent: Jul. 12, 1994

[54] SELF-LOCKING, TAMPER-EVIDENT PACKAGE

[75] Inventors: Kevin A. Kutz, Elkridge; Steven E. Parto, Westminster, both of Md.

[73] Assignee: The United States of America as represented by the Director of the National Security Agency, Washington, D.C.

[21] Appl. No.: 932,531

[22] Filed: Aug. 20, 1992

[51] Int. Cl.[5] ..... B65D 41/32

[52] U.S. Cl. ..... 220/266; 220/4.02; 220/4.21; 220/214; 220/265; 220/553; 220/556; 215/252; 215/253; 206/509

[58] Field of Search ..... 220/4.02, 4.21, 4.27, 220/214, 265, 266, 315, 553, 555; 215/250, 252, 253; 206/508, 509

[56] References Cited

U.S. PATENT DOCUMENTS

| | | | |
|---|---|---|---|
| 2,884,123 | 4/1959 | Dann et al. | 206/43 |
| 4,474,305 | 10/1984 | Marco | 220/307 |
| 4,493,433 | 1/1985 | Sideri et al. | 220/306 |
| 4,646,926 | 3/1987 | Agbay et al. | 215/203 |
| 4,658,980 | 4/1987 | Lindstrom | 220/214 |
| 4,711,363 | 12/1987 | Marino | 220/266 |
| 4,711,372 | 12/1987 | Gach | 222/23 |
| 4,724,977 | 2/1988 | Cleevely et al. | 220/258 |
| 4,757,898 | 7/1988 | Klein | 206/459 |
| 4,771,923 | 9/1988 | Zinnbauer | 222/153 |
| 4,785,963 | 11/1988 | Magley | 220/266 |
| 4,793,503 | 12/1988 | Town et al. | 215/250 |
| 4,793,504 | 12/1988 | Towns et al. | 215/250 |
| 4,934,554 | 6/1990 | Edwards | 220/266 |
| 4,934,557 | 6/1990 | Smith | 220/276 |
| 4,942,974 | 7/1990 | Larrison | 220/214 |

*Primary Examiner*—Allan N. Shoap
*Assistant Examiner*—Nova Stucker
*Attorney, Agent, or Firm*—Adlynn P. Kustin; Thomas O. Maser

[57] ABSTRACT

A high security tamper evident package for the shipping and storing of a variety of highly proprietary electronic components. The package has a lid and a multi-compartmented base which are threaded together to actively engage an automatic locking system enabled by breakaway tabs on the wall of the base sliding over and engaging behind ramps protruding from the inner surface of the lid. Upon unscrewing the base from the lid, the tabs break off as pressure is applied by movement against the back of the ramps, leaving permanent evidence of the package having been opened. A textured grip on the bottom of the package provides ease of handling and fits snugly onto a raised ring on the top of another package to allow for easy stacking and efficient storage.

10 Claims, 8 Drawing Sheets

SELF-LOCKING, TAMPER-EVIDENT PACKAGE

BACKGROUND

1. Field of the Invention

This invention relates in general to tamper evident packaging, and more particularly to a self-locking container for small parts which, although it can be reclosed for storage, once accessed provides visual evidence of its opening and cannot be relocked. Unauthorized opening of the container can thereby easily be detected.

Various applications for this type of container are contemplated. In Government, industry, and public use, electronic parts, memory chips, security keys, and other small devices must often be shipped and stored securely, and be easily identifiable. These parts often contain information which, if disclosed to unauthorized persons, could be harmful to national or corporate security. Many times the danger lies not in access to the device itself, but in the possibility that if access remains undetected, adversaries can exploit information from the equipments in which these electronics ultimately reside. With knowledge of the technology and codes contained within the electronics, or by simply having undetected access to an ordinary house key, would-be criminals can continue unnoticed. Thus, there is a need for a storage system which will enable detection of unauthorized access, is inexpensive to manufacture, and provides sophisticated protection for delicate electronic components.

2. Description of the Prior Art

Many tamper evident packages are known in the prior art. Many of these packages are designed to protect food or drugs from unnoticed contamination, as disclosed in U.S. Pat. Nos. 4,711,363, 4,474,305, 4,934,557, and 4,658,980, using an external tear off strip or tab. This type of container provides a level of protection sufficient for the unsophisticated tamperer, but the external nature of the locking mechanism provides direct access so that with the proper tools, such devices can be opened and resealed without obvious visible signs of pilfering. Such containers may not be self locking, so sealing might be impractical for users of a relatively small number of such containers, or for those who will be packing items at remote locations. Further, these inventions do not provide for protective packaging of small, delicate parts.

Magley's U.S. Pat. No. 4,785,963 discloses a "Tamper-Evident Buttress Plug Closure" which is designed for sealing closed a plastic 55-gallon drum. As the plug is threadedly advanced onto the outlet neck of the drum, it first engages the threads, then the ratchet on the neck. Frangible elements connect the ratchet ring to the outlet neck. In order to remove the plug, the frangible elements must be broken to disengage the ratchet mechanism, using a separate tool. In addition to being designed for different materials for different purposes, the present invention requires no separate ratchet ring, nor a preparatory action to disengage the closure, rather the lid ramps function both as ratchet teeth and as the tool to break off frangible elements.

U.S. Pat. No. 4,771,923 to Zinnbauer describes a "Tamper Evidencing Cap" designed to allow liquid to dispense from a bottle. The device includes a removable part connected to the exterior of the cap by frangible elements which are broken by unscrewing the cap thereby allowing liquid to pour through the opening. The Zinnbauer device provides external access to the tamper indicating mechanism and does not provide for protection of delicate solid material objects.

Although Towns and Brown provide internal tamper evidencing means in their U.S. Pat. No. 4,793,504, the closure relies on a cap liner membrane which is torn with the cap opening movement. The liner is made of a separate materials and requires relatively complex manufacturing processes.

More similar in its nature is the "Self-Locking Pilfer Proof Tamper Evident Container" as disclosed in U.S. Pat. No. 4,493,433 to Sideri and Del Brocco. The design of the Sideri, et al. container provides a physical barrier against opening of the container using interlocking tabs. Once engaged, the tabs cannot be separated. Once locked, access to the package requires substantial physical force, which could damage delicate electronic components. The Sideri, et al. package is destroyed upon opening, and cannot be used for storage after one use. The invention contemplated here utilizes a twisting motion of tabs against a barrier via the unscrewing of the two parts of the device. This provides an obvious stress pattern on the broken tabs and protects against a sophisticated adversary replacing the tab to hide evidence of tampering. After its first use, the instant invention can be reassembled for storage, and fitted with a high security tape which will provide a lower level of security during storage.

Although the prior art contains many patents which provide some level of protection against casual physical tampering, none has incorporated design features to provide separate, fitted partitions to hold delicate, or oddly shaped items while protecting against adversaries seeking electronic information from the items stored within them.

SUMMARY OF THE INVENTION

By the present invention, we have conceived a self-locking, high security, tamper-evident container by which we were able to address the foregoing disadvantages. Thus, the objects of our invention are to provide a self-locking high security tamper evident package which, while easy to manufacture and use, provides compartments for many different components, resealing and storage features, and by its shape, material, and internal locking system, protection against virtually any form of pilfering.

To accomplish these and other related objectives of the invention, a high security, tamper-evident package for electronic and other components is provided which comprises a hollow, generally cylindrical shaped lid portion closed at its top end and having internal threads originating at its open end, and a mated base portion having sidewalls with external threads. Frangible elements are formed as part of the base sidewall. A ratchet mechanism allows the two portions to be threadedly advanced into a locked position. Disengaging the lid and base requires the application of force in the reverse relative rotational direction. The ratchet teeth then break the frangible elements, providing a permanent visible indication that the package has been opened.

BRIEF DESCRIPTION OF THE DRAWINGS

The best mode of the invention has been chosen for purposes of illustration and description, as shown in the accompanying drawings, forming a part of the specification wherein.

DETAILED DESCRIPTION OF THE PREFERRED EMBODIMENT

Figure 1:
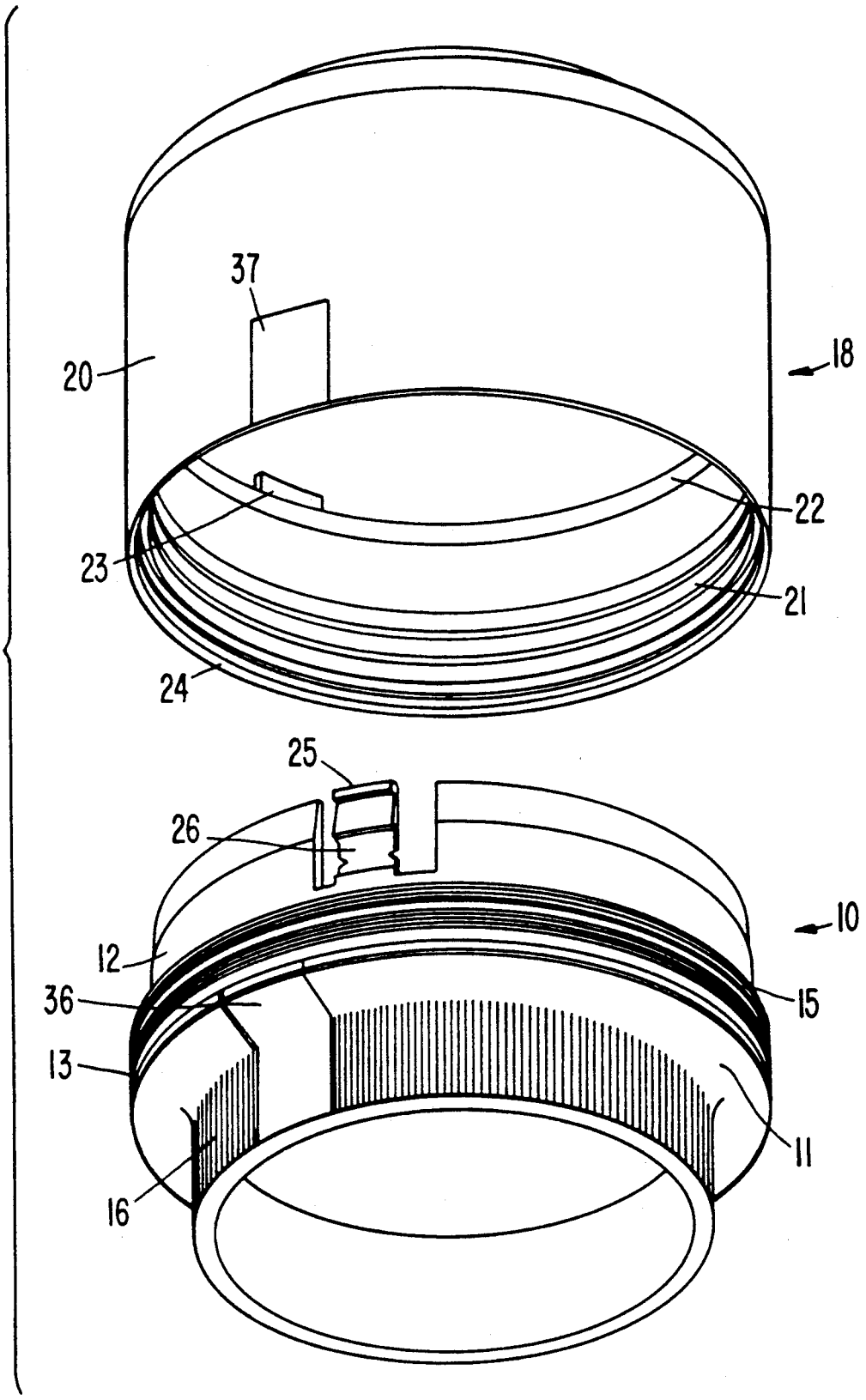
FIG. 1 is an exploded perspective view according to the invention.
Figure 2:
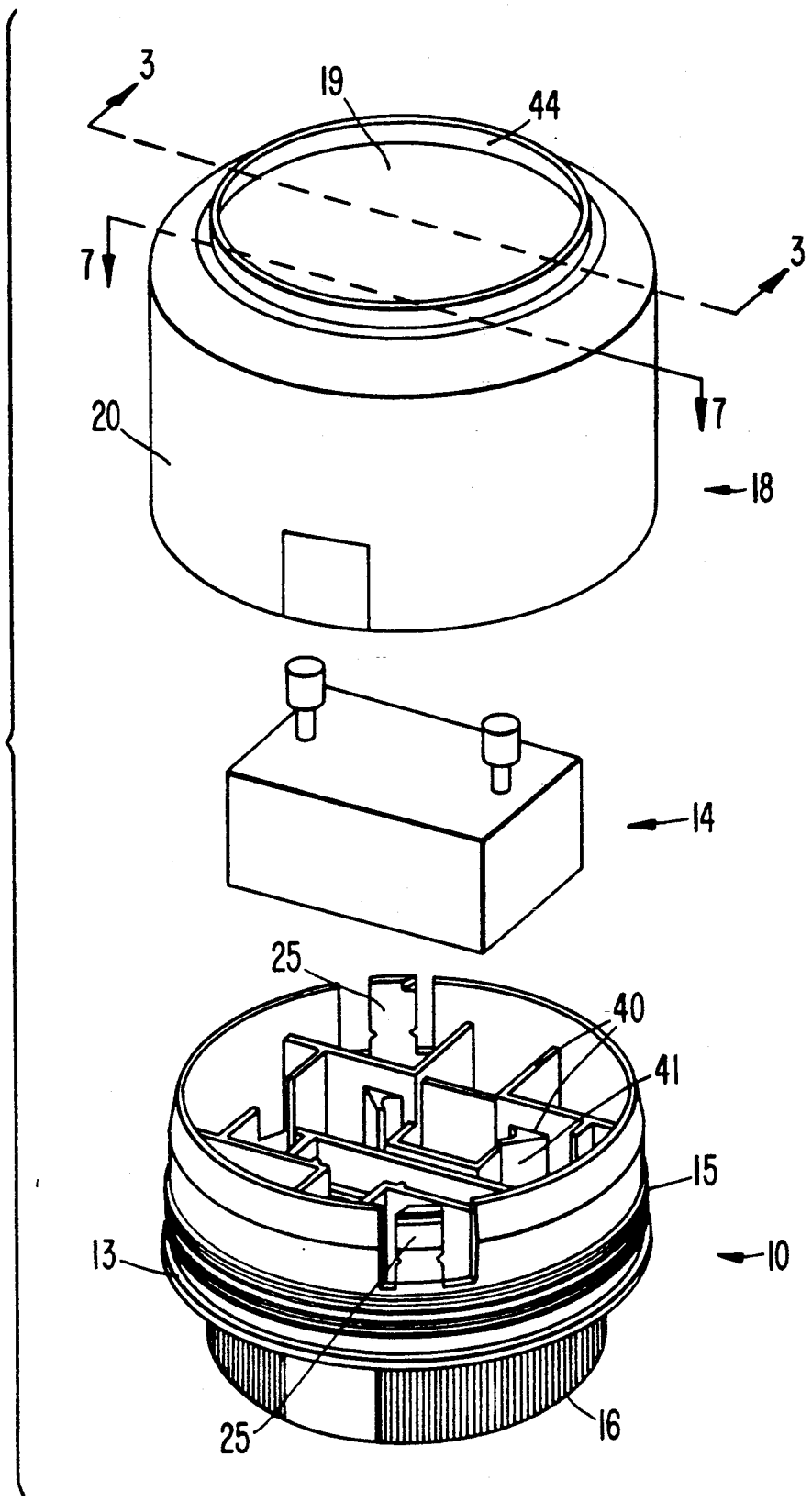
FIG. 2 is an exploded perspective view according to the invention illustrating the position of a component to be contained within.

Referring now to the drawings, and more particularly to FIGS. 1 and 2, there is shown a first or base portion 10 which includes a circular platform 11 and a sidewall 12 extending at 90 degrees from the circular platform 11 to form a base flange 13 and a cylindrical cavity for receiving electronic and other components such as a plug device 14 to be contained therein. The sidewall 12 has threads 15 on its exterior. A grip 16 extends downward from the platform 11. In the preferred embodiment, the grip 16 is textured to provide ease of handling, and both the inside and outside surfaces are curved as they join the bottom of the circular platform 11.

A second or lid portion 18 is in position opposite to the base portion 10 to cover the enclosure. This lid portion 18 is a hollow cylinder with one closed end forming the top 19 of the device as shown in FIG. 2. The lid sidewall 20 is disposed at a radius just larger than that of the base sidewall 12 and has threads 21 opposing the base threads 15 so that the lid portion 18 can be threadedly engaged with the base portion 10 (see FIG. 3). FIGS. 1 and 2 illustrate that at the inner end of the lid threads 21, a retaining rim 22 precedes one or more ratchet teeth shown in the preferred embodiment as ramps 23 disposed on the lid sidewall 20 and positioned at 170 degrees from one another At the open end of the lid 18 the lid sidewall 20 is thinned on its interior to form a small step 24.

Figure 3:
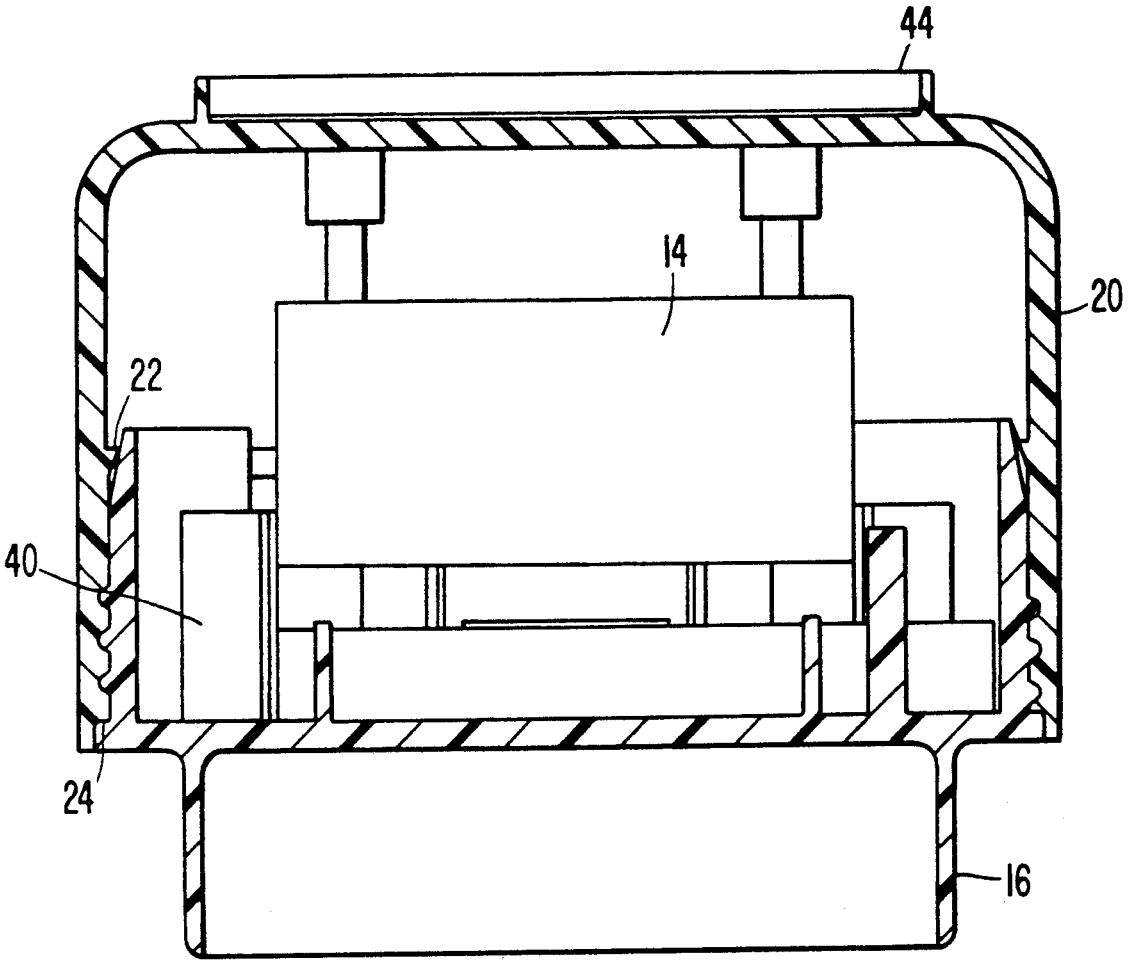
FIG. 3 is a vertical section taken along line 3—3 of FIG. 2 illustrating the device in its locked position with a component stored within.
Figure 4:
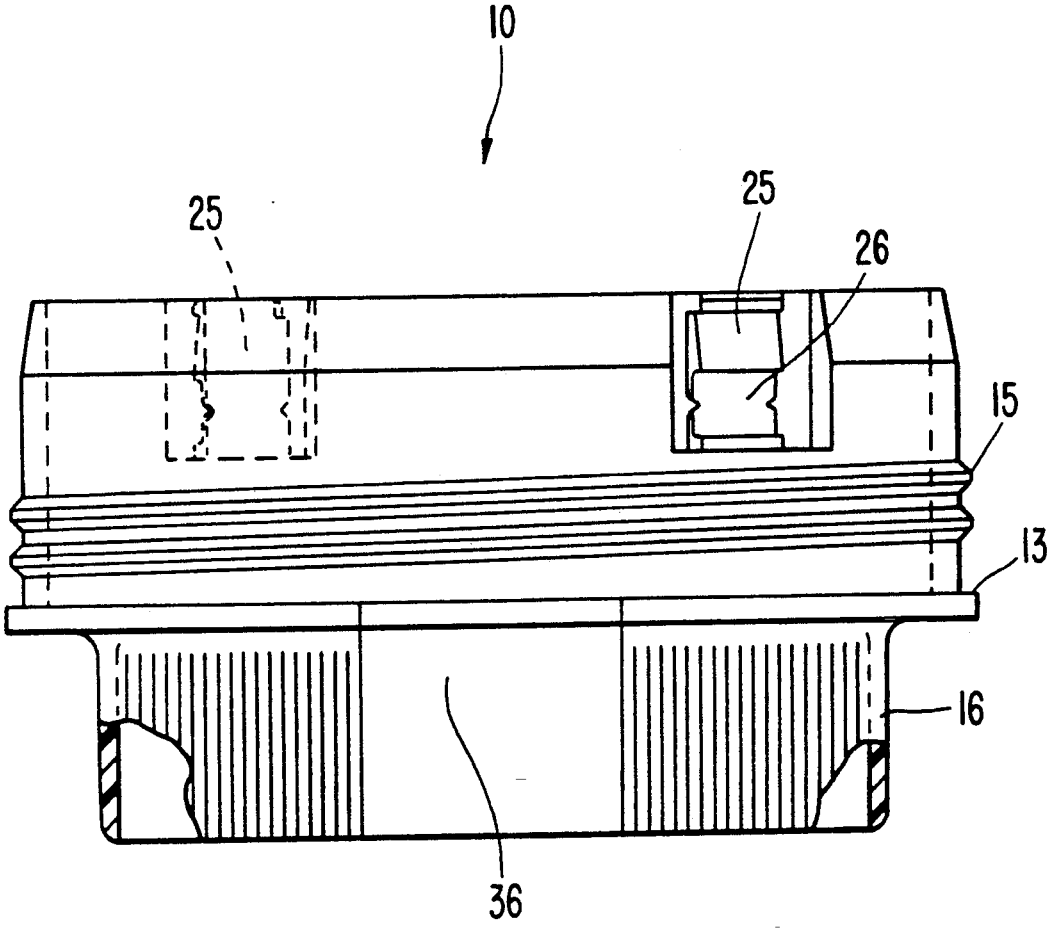
FIG. 4 is an elevational view of the base portion of a device according to the present invention.

According to the preferred embodiment as shown in FIG. 1, the base threads 15 are located at a distance from the base flange 13 such that when the base 10 and lid 18 locked together, the lid step 24 rests flush against the base flange 13 as illustrated in FIG. 3, and the outermost end of the lid portion is flush with the bottom edge of the base platform 11. FIG. 4 illustrates that in our preferred embodiment, there are enough threads to require two and a half turns to lock the package. This provides adequate protection against attempts at pilfering while not over burdening the user.

Figure 5A:
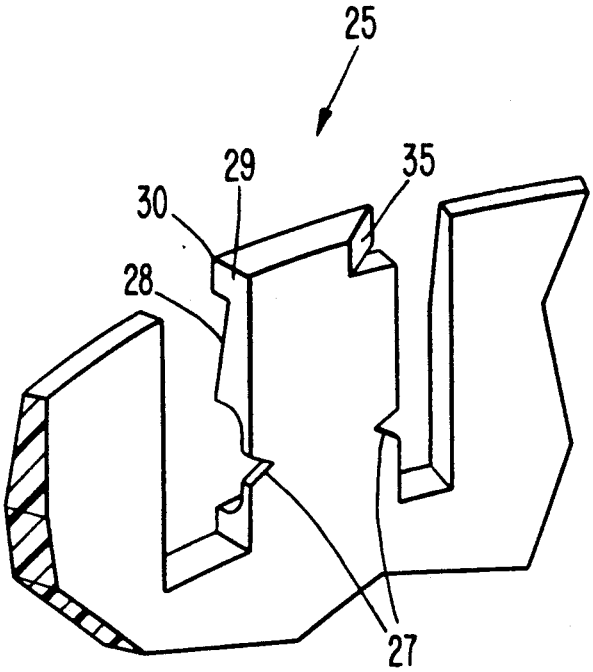
FIG. 5A and FIG. 5B are partial views of the base sidewall illustrating the interior and exterior of the breakaway tabs.
Figure 5B:
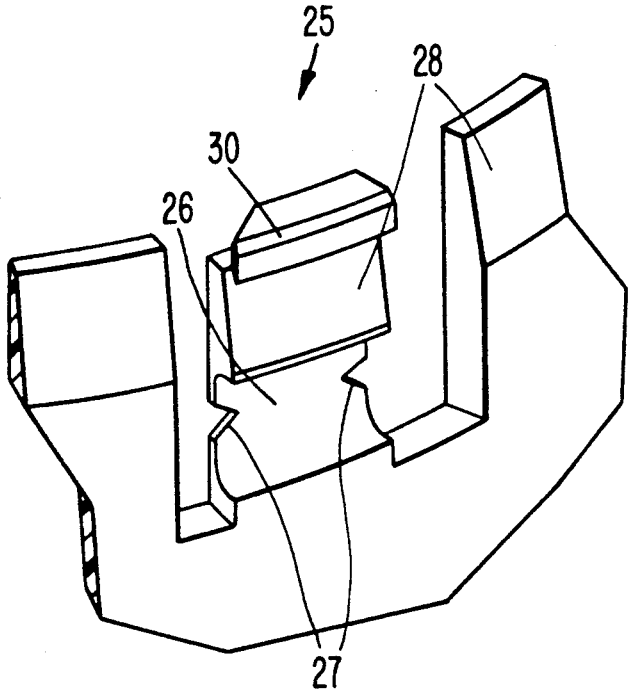
Figure 6A:
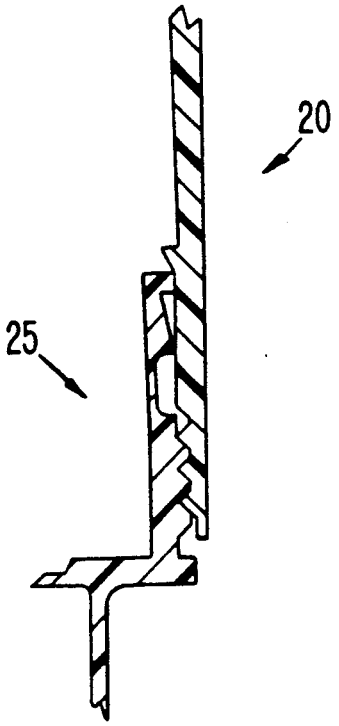
FIGS. 6A, 6B, 6C, and 6D are partial vertical sections illustrating the locking tabs of the base portion, and the retaining rim and ramps of the lid portion in sequence as the lid and base are threaded together.
Figure 6B:
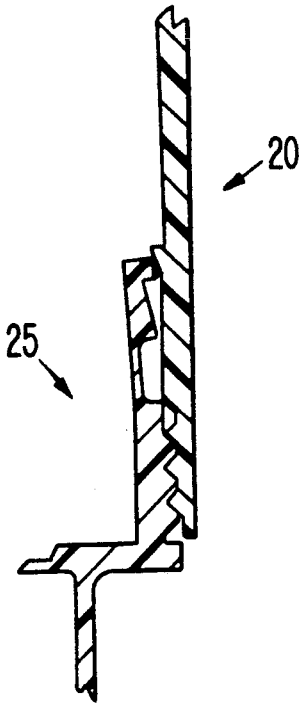
Figure 6C:
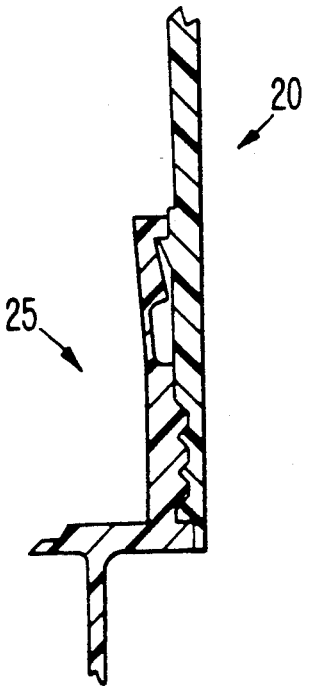
Figure 6D:
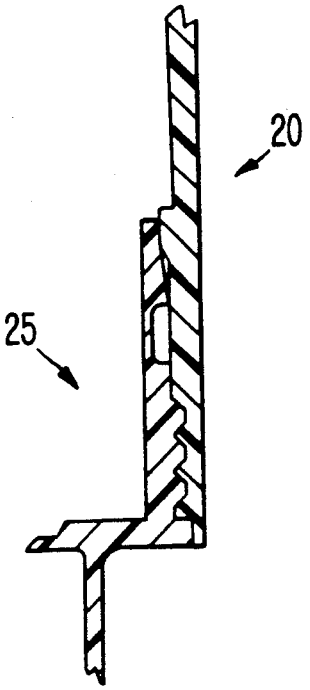

As a means for engaging the lid ramps 23—23, the base sidewall 12 at its most distal end has preferably two breakaway tabs 25—25 which, in the preferred embodiment are disposed 180 degrees from each other FIG. 5 shows in detail that tabs 25—25 are formed by providing gaps in the base sidewall 12. The gap on the right side (when viewed from the outside) of each tab 25 must be large enough to allow the tab 25 to twist off. The tabs 25—25 are generally rectangular in shape extending upward from base threads 15. At the end closest to the base platform 11, after a small distance, a weakened section 26 is created by thinning the material across the width of the tab on its exterior as viewed in FIGS. 1, 2, 4, and 5. Notches 27—27 are molded into each side of the weakened section 26 to provide a stress concentration for the initiation of a fracture. Above the weakened section 26, the material has an angled surface 28 which extends around the entire circumference of the base sidewall 12 and terminates at an outwardly extending lip 29, thereby providing a hook. Although generally rectangular, the upper outward edge of the lip 29 is chamfered as shown in FIG. 5 and FIG. 6 to provide a sliding surface 30 against the incline of the retaining rim 22 during assembly of the device. FIGS. 6A, 6B, 6C, and 6D illustrate a tab 25 threadedly advancing over the retaining rim 22 and a lid ramp 23. FIG. 6A shows the tab approaching the rim. FIG. 6B illustrates the tab resiliently flexing as it slides up the incline of the rim. FIG. 6C illustrates the tab after it has advanced passed the rim and is sliding along the ramp. FIG. 6D illustrates the tab engaged above the retaining rim and behind the ramp.

Figure 7:
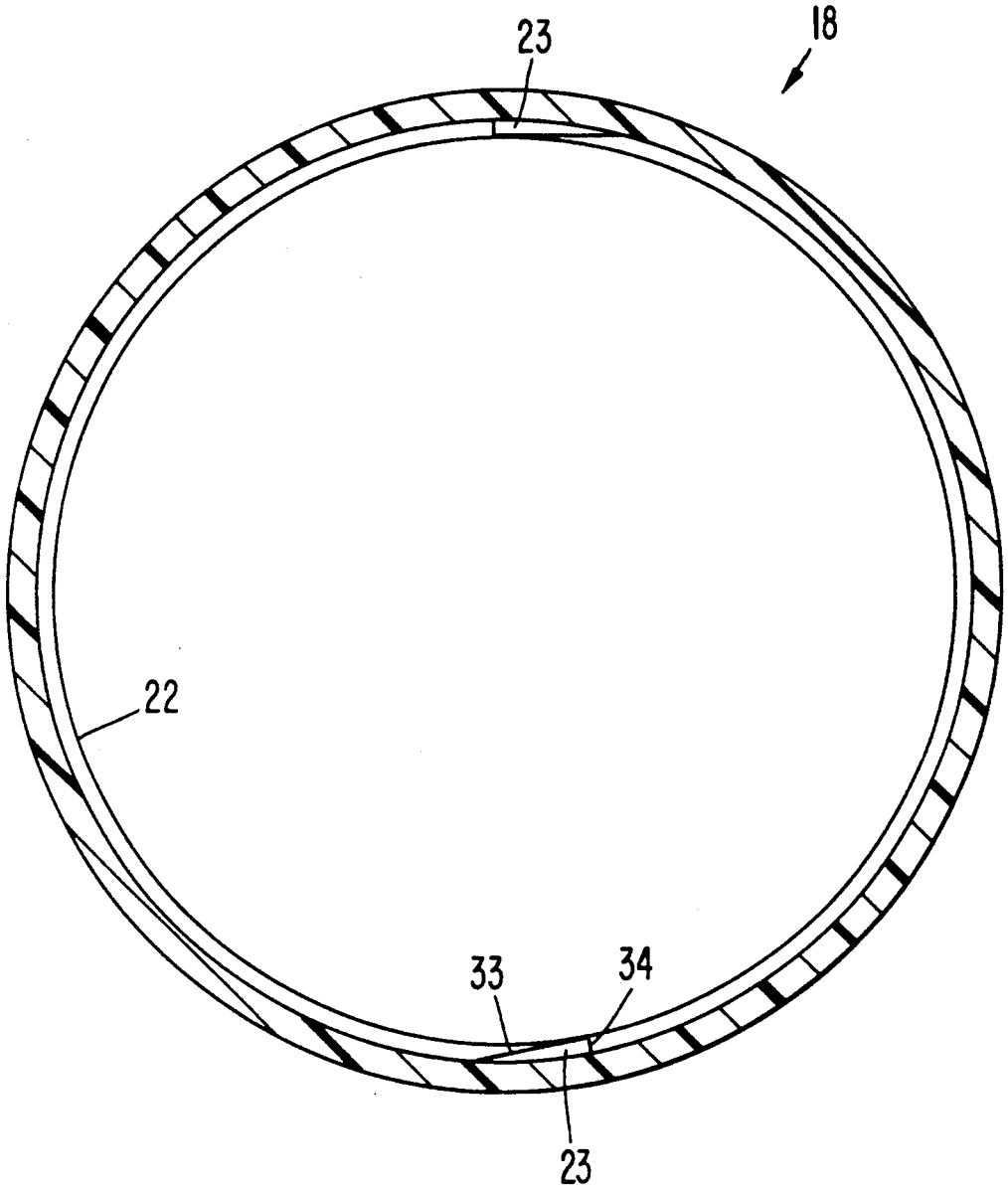
FIG. 7 is a horizontal section of the lid portion of the device taken along line 7—7 of FIG. 2.
Figure 8:
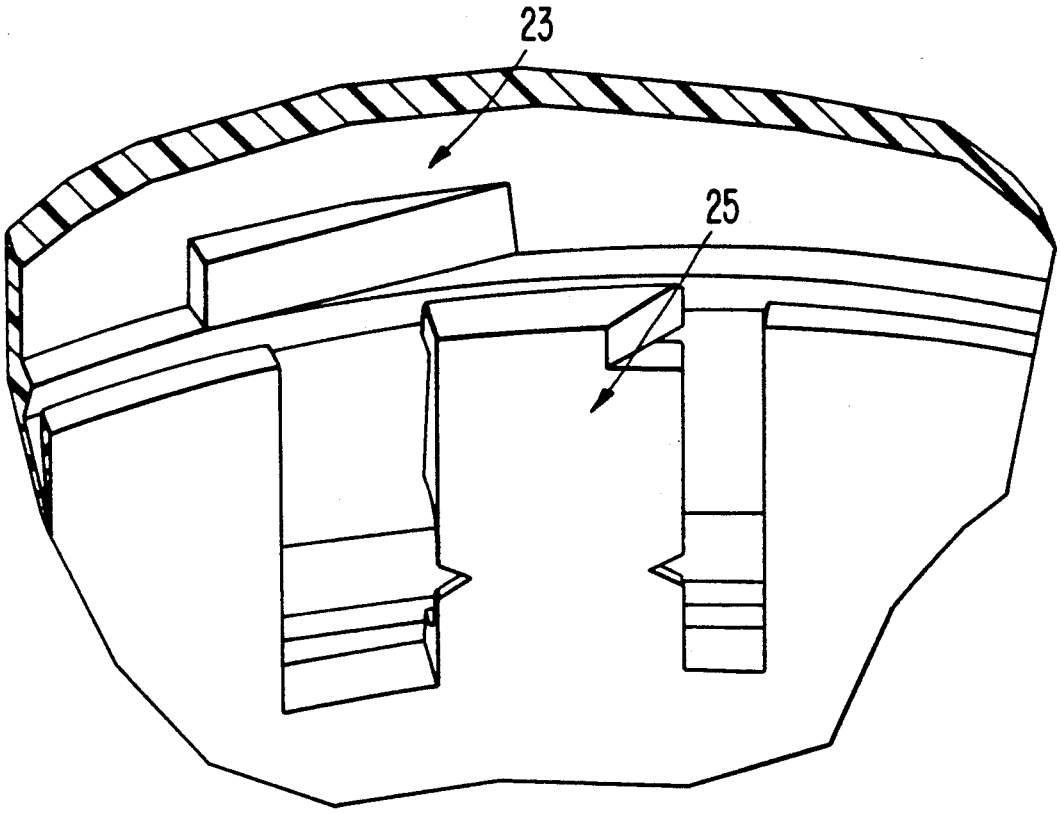
FIG. 8 is a perspective view of a tab and ramp during assembly of the device.

Once the tabs' lips 29—29 are positioned above the rim 22, the ramps 23—23 are located such that contact is immediately provided between one of the tabs 25 and a ramp 23 (see FIG. 6C). Because the second of the tabs 25—25 is offset 10 degrees from its corresponding ramp 23 there is a slight delay before the second tab 25 contacts the second ramp 23. As illustrated in FIG. 7, the ramps 23—23 provide a sliding surface 33 during assembly of the device, and a stopping surface 34 during disassembly, functioning essentially as ratchet teeth. FIG. 8 illustrates the relative position of a tab 25 and a ramp 23 as they approach one another during assembly. After each tab has passed the sliding surface 33 of a ramp 23, each tab 25 snaps forward to its original vertical position thereby engaging over the retaining rim 22 and behind the stopping surface 34 of the ramp 23. Audible and tactile signals, as well as a visual inspection through transparent material indicates proper engagement as shown in FIG. 6D. FIG. 5A further illustrates that when viewed from the outside, the left edge of the tab lip 29 is has a contact edge 35 angled at 45 degrees from outside to inside. Upon disassembly of the device, as the side of each tab 25 comes into contact with the stopping surface 34 of the ramp 23 the contact edge 35 of the lip 29 provides the necessary surface to prevent a tab 25 from twisting around and over a lid ramp 23 instead of breaking off as is intended. The slight offset of the two tabs 25—25 to one another provides an added measure of insurance against malfunction upon disassembly by concentrating the applied breaking force to each tab 25 independently.

Once assembled, opening the device will permanently disable the tabs 25—25, but the lid 18 and the base 10 can be reassembled for storage of the product contained therein. Indentations 36 and 37 illustrated in FIG. 1 are provided on the bottom of the base platform 11 and the outside of the lid sidewall 20 respectively, for receiving retro-reflective or other tamper indicating tape. Such tapes will provide a small measure of security for the device sealed within.

As illustrated in FIG. 2, the preferred embodiment provides wall fins 40—40 and one or more pins such as 41 to hold components within the device. The wall fins 40—40 protrude from the base platform 11 and are designed to accommodate several sizes and shapes of components. FIG. 2 and FIG. 3 illustrate the placement of a plug device 14 within the base portion 10. The stored components are secured from above by the top of the lid 18 or by grommets (not shown) on the pin 41.

A further characteristic of the preferred embodiment is the ability to efficiently store many assembled devices in a safe drawer or other confined space. As shown in FIG. 2, a stacking rim 44 protrudes from the top of the lid 18. Its radius is such that it fits snugly within the circumference of the base grip 16.

The container thus described can be manufactured using existing injection molding techniques. We prefer to form the base portion of the device from high heat crystal polystyrene because of its strength while providing the necessary resiliency and brittleness for effective engagement and fracture of the breakaway tabs 25—25. The lid portion preferably is formed from transparent styrene acrylonitrile (SAN) to provide strength and durability. The transparency facilitates the detection of tampering and the reading of bar code data through its walls.

The container may have an indentation on its exterior for receiving a bar code label, shown for example in FIG. 1 and FIG. 4 on the grip 16. This provides the ability to match internal and external bar codes, adding to the security aspect of the device. In its preferred embodiment, the closed container measures $3\frac{3}{8}''$ high by $3\frac{3}{4}''$ in diameter.

We believe that the construction and application of our novel high security tamper evident container will now be understood and that the advantages thereof will be fully appreciated by those persons skilled in the art.

We claim:

1. A self-locking, tamper evident package comprising a lid portion and a base portion;

(a) said lid portion comprising a hollow, generally cylindrical shaped member closed at a top end, having an interior surface disposed with thread means for connecting to said base portion, a retaining rim, and at least one ramp shaped ratchet tooth;

(b) said base portion comprising a circular platform with a grip extending orthogonally from a bottom side and a sidewall extending orthogonally from a top side defining a hollow cylindrical cavity, said sidewall having thread means disposed on an exterior surface for engaging said lid portion thread means; and (c) at least one radially flexible, circumferentially frangible vertical breakaway tab forming a section of the base sidewall, such that said lid portion, when completely threaded to said base portion, engages said at least one breakaway tab over the retaining rim and behind the at least one ramp shaped ratchet tooth, thereby locking said lid and base portions, such that the disassembly of the lid portion from the base portion will result in a relative twisting motion of the at least one tab against a back surface of the at least one ratchet tooth thereby permanently and visibly shearing said at least one tab off from the base sidewall.

2. A self-locking, tamper-evident package according to claim 1 wherein said at least one tab is generally rectangular in shape.

3. A self-locking, tamper-evident package according to claim 1 wherein the at least one ramp shaped ratchet tooth and at least one tab comprise a plurality of ratchet teeth and tabs which are positioned such that they engage sequentially.

4. A self-locking, tamper-evident package according to claim 1 further comprising wall fins fixedly attached perpendicular to said base within its sidewall defining a plurality of partitions for holding in place particular components of varying shapes and sizes.

5. A self-locking, tamper-evident package according to claim 1 wherein the grip is textured to provide a gripping surface.

6. A self-locking, tamper-evident package according to claim 1 further comprising a ring extending orthogonally from the top of said lid for stacking.

7. A self-locking, tamper-evident package according to claim 1 further comprising tape indentations at an underside of said base portion and an outside surface of said lid portion in positions which are contiguous to one another when said base portion is locked onto said lid portion to provide for adhesive tape.

8. A self-locking, tamper-evident package according to claim 1 further comprising:

(a) a lip extending outwardly from each said at least one tab comprising a distal end having an inward side providing a sliding surface; and (b) a horizontal midsection within said at least one tab providing a weakened detachment line, said at least one tab being asymmetrically disposed within a gap in said base sidewall, whereby when force is applied against a leading edge of the lip of said at least one tab, said at least one tab fractures away.

9. A self-locking, tamper-evident package according to claim 8 wherein said horizontal midsection is notched at a trailing edge.

10. A self-locking, tamper-evident package according to claim 9 wherein the horizontal midsection is notched at a leading edge.

* * * * *